United States Patent [19]

Grant et al.

[11] 4,084,964

[45] Apr. 18, 1978

[54] HIGH HFC-CONTAINING ALLOYS

[75] Inventors: Nicholas J. Grant, Winchester, Mass.; Ramon K. Robinson, Richland, Wash.

[73] Assignee: Massachusetts Institute of Technology, Cambridge, Mass.

[21] Appl. No.: 664,208

[22] Filed: Mar. 5, 1976

Related U.S. Application Data

[60] Division of Ser. No. 371,318, Jun. 18, 1973, abandoned, which is a continuation of Ser. No. 664,207, Mar. 5, 1976.

[51] Int. Cl.[2] ..... C22C 19/08

[52] U.S. Cl. ..... 75/171; 75/.5 C; 75/251

[58] Field of Search ..... 75/171, 170, .5 BA, 75/.5 BC, .5 C, 251; 148/32, 32.5

[56] References Cited

U.S. PATENT DOCUMENTS

| | | | |
|---|---|---|---|
| 3,244,506 | 4/1966 | Reen | 75/171 |
| 3,549,356 | 12/1970 | Sims et al. | 75/171 |
| 3,746,518 | 7/1973 | Holtz | 75/171 |

*Primary Examiner*—R. Dean

*Attorney, Agent, or Firm*—Arthur A. Smith, Jr.; Robert Shaw

[57] ABSTRACT

A new class of cobalt-based alloys and the like containing hafnium carbide (HfC) of particle size finer than about 3 microns and containing HfC in the range 2 to 15% by volume. The class has good strength characteristics at both very high and very low temperatures, it exhibits very good stability, and it has excellent oxidation characteristics even at temperatures at 2000° F and above. In addition, the alloy has ductility and low-temperature toughness characteristics that make it attractive for wrought processes.

4 Claims, 18 Drawing Figures

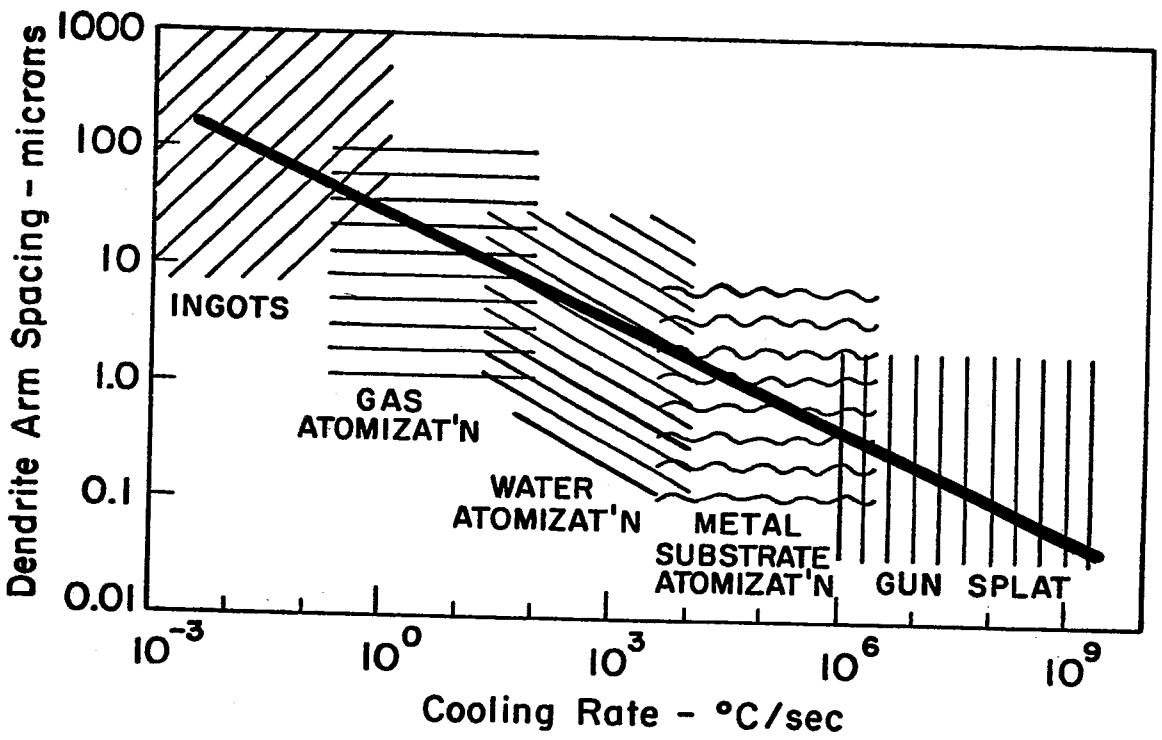
FIG. 1 Dendrite arm spacing as a function of cooling rate for aluminum and aluminum alloys.

FIG. 3a
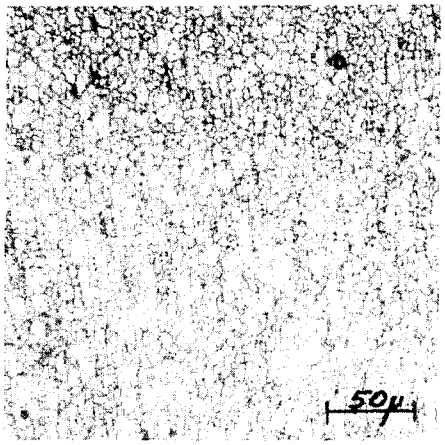
FIG. 3b
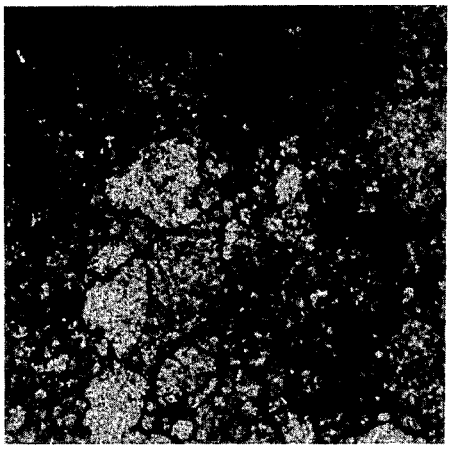
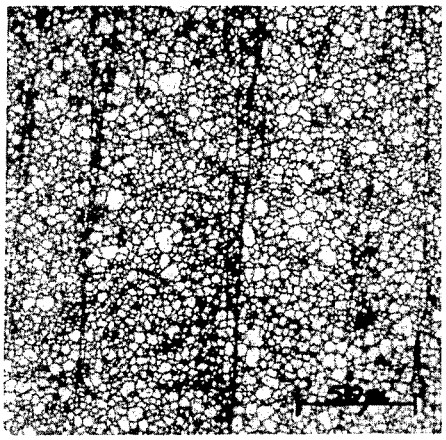
FIG. 3c
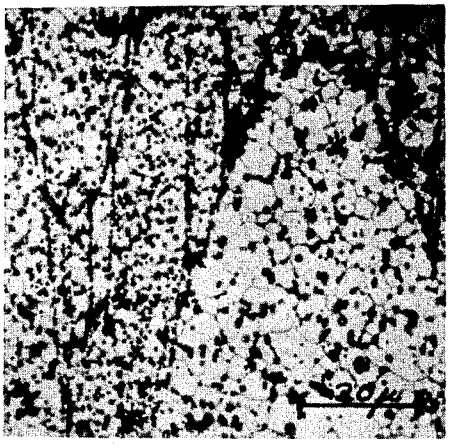
FIG. 3d

FIG. 4a
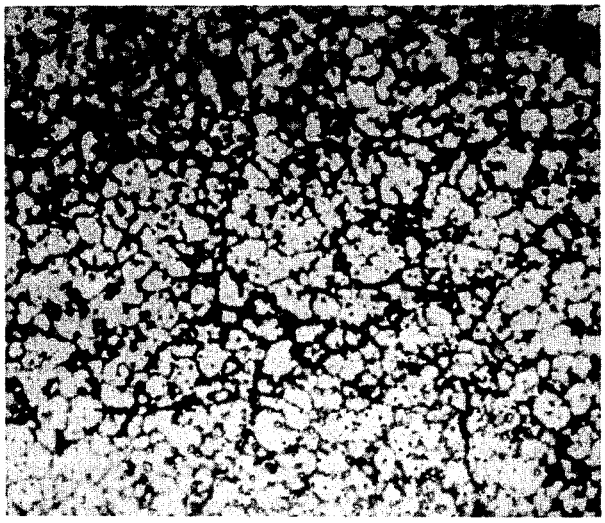
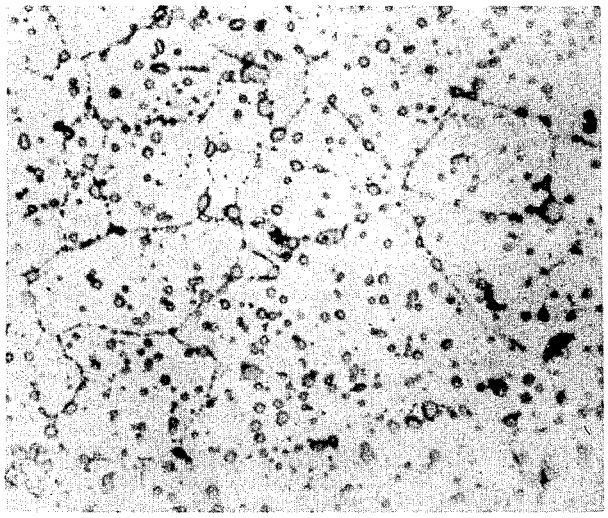
FIG. 4b

EFFECT OF TMT ON 1800°F (982°C) STRESS RUPTURE PROPERTIES OF COBALT-3 ATOM % HfC (CH6-H1-HE).

EFFECT OF TMT ON 1500°F (815°C) STRESS RUPTURE PROPERTIES OF COBALT-3 ATOM % HFC.

EFFECT OF TMT ON 1200°F (649°C) STRESS RUPTURE PROPERTIES OF P/M COBALT-1 AND 3 ATOM % HfC.

EFFECT OF TMT ON 1800°F (982°C) STRESS RUPTURE PROPERTIES OF P/M MAR-M-509.

EFFECT OF ANNEALING TREATMENT ON 1800°F (982°C) STRESS RUPTURE PROPERTIES OF P/M MAR-M-509.

HIGH HFC-CONTAINING ALLOYS

The Government has rights in this invention pursuant to Contract No. DAHC15-70-C-0283 awarded by the Advanced Research Project Agency of the Department of Defense.

This application is a division of Ser. No. 371,318, filed June 18, 1973, now abandoned in favor of a continuation application, Ser. No. 664,207, filed Mar. 5, 1976.

The present invention relates to metallurgical processes wherein substantial quantities of very small-sized hafnium carbide (HfC) is uniformly dispersed in a cobalt-based alloy and the like and to the alloy that results therefrom.

This specification draws heavily upon the doctoral thesis of the inventor Robinson hereby incorporated herein by reference; the thesis, which is entitled "Development of P/M Cobalt-Base Alloys Using Rapidly Quenched, Pre-Alloyed Powders", reports work by Robinson done under the supervision of the inventor Grant. A copy of the thesis was filed with said application Ser. No. 371,318; a copy of the thesis was deposited in the M.I.T. library system or on about Sept. 11, 1973. Information by way of background and related work and amplification of the instant specification may be obtained from the thesis and from the references made of record in the bibliography thereof. In the discussion that follows, the invention is described mostly with reference to cobalt-based alloys; the teaching herein, however, applies, as well, to alloys wherein some or all the cobalt is substituted by nickel or nickel plus iron, the substitution of nickel for cobalt being well known in the art to which the invention pertains.

High strength, oxidation resistant, easily fabricable, inexpensive alloys having good ductility, toughness strength and stability at temperatures even of the order of 2200° F (1903° C) are needed for many present day requirements. These qualities can be attained in cobalt-based alloys containing significant amounts of hafnium, but the necessary quantities of hafnium have, prior to the present work, resulted in inferior metals. Accordingly, an object of the present invention is to provide a new class of cobalt-based alloys, a class which meets the foregoing needs.

Another object is to provide a powder metallurgy (P/M) process for making such cobalt-based alloys, a P/M process which permits the necessary large quantities of hafnium in the product without the structural deficiencies ordinarily encountered.

These and still further objects are discussed hereinafter and are particularly delineated in the appended claims.

By way of summary, the objects of the invention are attained in a process for making an alloy (and the alloy that results from the process) containing a uniform-dispersion of extremely fine and stable microconstituent phases in a cobalt-based alloy containing 10–30 weight % chromium, 4–12 weight % of tungsten and/or molybdenum, 3–15 weight % hafnium, sufficient carbon to produce hafnium carbide in the alloy, and the balance cobalt. It is understood that up to 30% of the cobalt can be substituted by nickel or nickel plus iron. The process includes the steps of raising the temperature of the metal composition until it is in the liquid state and then rapidly cooling the liquid melt at a rate greater than the order of $10^2$ and as high as $10^7$° C/second, thereby to form a solid having secondary dendritic arm spacings of 10 microns or finer. The necessary rapid cooling can be effected by atomization of the liquid melt into fine droplets which are rapidly quenched in an atomizing fluid or are quenched against a metallic substrate, for example, copper rolls. Fluids that can be used include inert gases, air, steam, water, nitrogen and hydrogen. The use of high quenching rates sharply optimizes the formation of HfC (i.e., preferentially forms HfC) to the general exclusion of the less desirable carbides which would form at slower solidification and cooling rates, carbides such as the chromium and molybdenum or tungsten carbides.

The invention is hereinafter discussed with reference to the accompanying drawing in which:

FIG. 1 is a graph showing dendrite arm spacing as a function of cooling rate for aluminum and aluminum alloys;

FIGS. 2*a*, 2*b* and 2*c* are reproductions of photomicrographs (X300) showing dendrite structures of atomized powders formed respectively of steam atomized Co-1 HfC, 3mm diameter, rotating electrode atomized Co-2, 0.4 mm diameter, and vacuum atomized Co-3 HfC, 0.3 mm diameter;

FIGS. 3*a*, 3*b*, 3*c* and 3*d* are reproductions of photomicrographs showing microstructure of Co-HfC alloys of the present invention formed by hot isostatic pressing (HIP) and extrusion of powders containing respectively 1 atom % HfC (X300), 1 atom % HfC after re-HIP, darkfield (X200), 2 atom % HfC (X400) and 3 atom % HfC (X1000);

FIGS. 4*a* and 4*b* are reproductions of photomicrographs (X1500) showing HIP and extruded powders of Co-HfC powders made using the present process, having 3 atom percent HfC and showing the worked powders respectively in the as-extruded condition and after a 1-hour anneal of 2440° F (1340° C);

Before going into a detailed discussion of the invention, some brief preliminary remarks follow. The discussion herein revolves mostly around powder metallurgical processes (P/M), but other techniques may be employed within the teaching. The most common quenching processes for generating powders employ water, air, steam, inert gases (e.g., argon, helium, etc. and including nitrogen), and soluble gases (i.e., hydrogen) for disintegrating the molten metal into droplets Quench rates for conventional ingot or casting processes are on the order of $10^{-2}$–$10^{-1}$° C/second but rates as high as $10^{2}$° C/second or higher are reported for some atomization processes as depicted schematically for aluminum alloys in FIG. 1. (The present technique employs quench rates of $10^{2°}$ C/second and higher). Since powder forming techniques are now widely employed in industry, further discussion thereof is not needed here, it being sufficient to note that the metal composition which is atomized to form the powder is first raised in temperature until the whole of it is in the liquid state, the liquid melt being then disintegrated (subdivided) and cooled. The powder thus formed finds greatest usage in wrought metal processes and the present invention is directed to providing cobalt-based alloy which is sufficiently malleable to be useful in such wrought processes.

Many of the desired material qualities of such cobalt based alloys are enhanced by the addition of significant amounts (3–15 weight %) of hafnium. Prior to the present work, however, the addition of these amounts of hafnium to such alloys was not particularly attractive because prior-art techniques results in large amounts of coring, micro and macrosegregation with large secondary dendrite arm spacing (i.e., ~ 50–1000 microns) and, thus, a highly segregated and frequently, a brittle nonworkable material. Furthermore, to be useful, hafnium must be present in sufficient quantity to unite with carbon in the alloy to at least the order of 2 volume percent and often as high as 3–10 or 3–15 volume percent; and no known prior-art work presents that as a possibility.

Figure 2C:
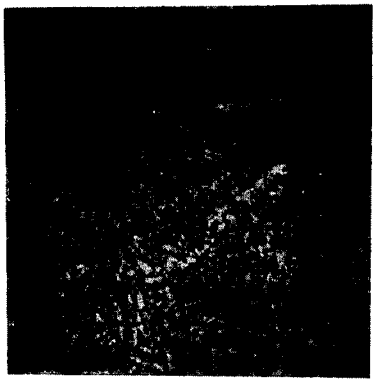
Figure 2B:
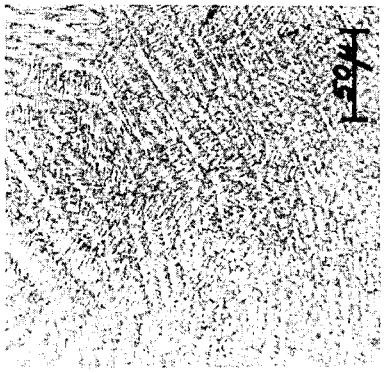
Figure 2A:
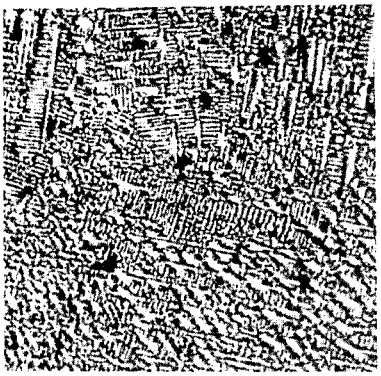

The process of this invention produces a uniform dispersion of extremely fine and stable microconstituent phases (i.e., HfC) in a cobalt-based alloy powder containing 10–30 weight % chromium, 4–12 weight % tungsten and/or molybdenum, 3–15 weight % hafnium with carbon to produce hafnium carbide in the alloy, and the balance cobalt. The constituent materials, as before noted, are melted, they are left in the liquid melt state sufficiently long to allow homogenization to occur, and then the melt is rapidly cooled at least the order of $10^{2°}$ C/second. It has been found for present purposes that $10^{2°}$ C/second cooling provides maximum secondary dendrite arm spacing of about 10 microns and, in hot working, leads to maximum grain sizes of about 20 microns; higher cooling rates lead to finer dendrite arm spacing (FIG. 1) and a correspondingly smaller grain sizes in the wrought product. Examples of typical dendrite arm spacings in atomized Co-HfC alloys are shown in FIG. 2. The resulting alloy, Co-HfC, has dispersed therein fine precipitates of HfC in an austenitic or other cobalt matrix (FIG. 3). The carbon typically is balanced stoichiometrically to produce hafnium carbide in the powder. In addition to the mentioned constituents, the alloy can contain one or more of the group consisting of titanium, tantulum, columbium, zirconium or the group consisting of lanthanium, cerium or other rare earths in total amount of 0–3 weight percent of one group. Also, small amounts of boron and/or silicon can be included to assist in atomization in the powder process. The Co-HfC powder contains HfC of particle size finer than about 3 microns uniformly dispersed therein in amounts by volume in the range of 2 to 10%. It can contain small amounts of chromium carbide or other refractory carbides in quantities of less than 20 volume percent of the HfC.

Example 1 below describes the preparation of a single alloy using the present teaching; Example 2 is more general and the process outlined includes the process of Example 1; and Example 3 is a special aspect of the more general process of Example 2.

EXAMPLE 1

Figure 5:
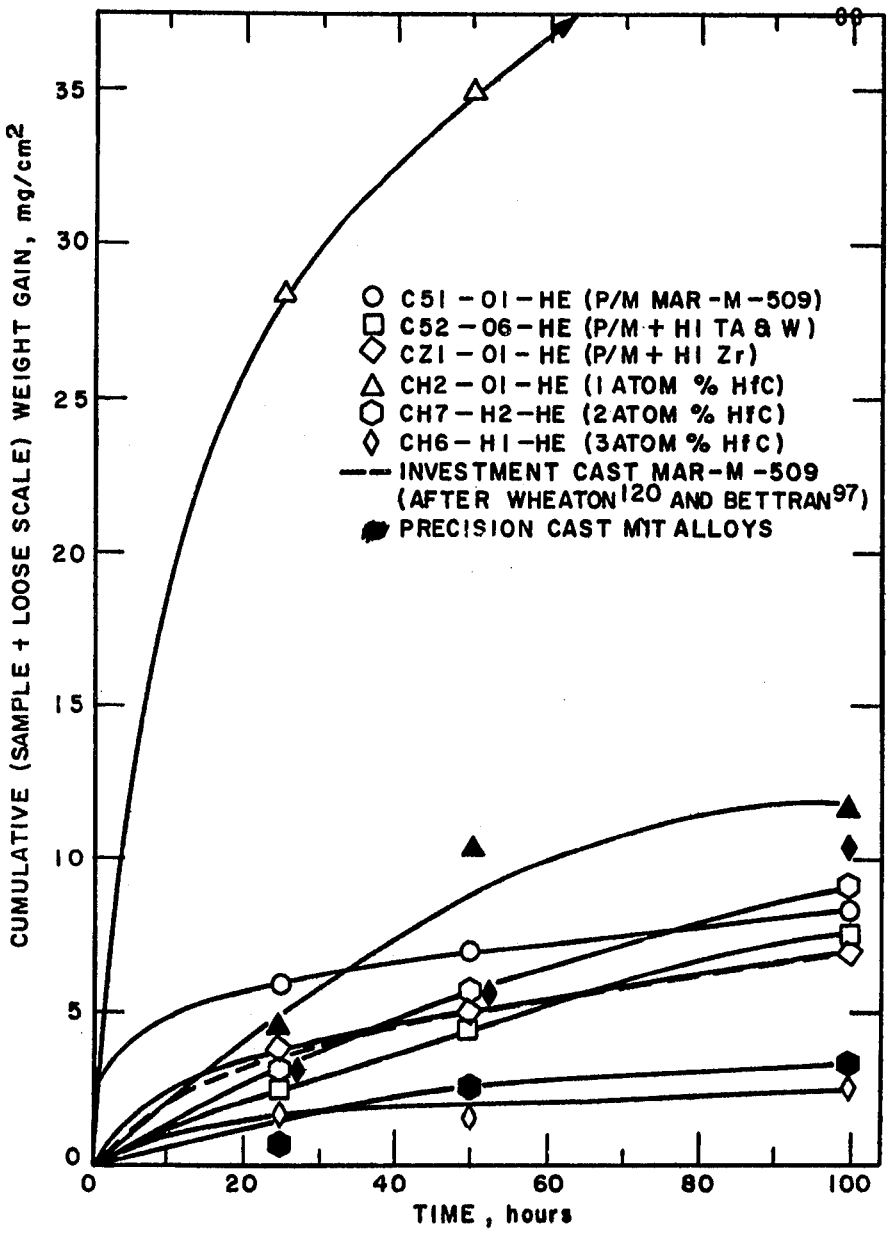
FIG. 5 is a graph of pseudo-dynamic oxidation characteristic of a group of powder metallurgy (P/M) and case cobalt-based alloys in still air at 2000° F (1093° C)

To illustrate the concepts described herein, one of the powder metallurgy Co-HfC alloys in said thesis is now described: a Co-21, Cr-10, Ni-, 9Hf, 5Mo, 0.6 C alloy was melted, hydrogen-vacuum atomized (FIG. 2A), consolidated by hot isostatic pressing (HIP), hot extruded and evaluated. A stable, fine and uniform dispersion of HfC (nominally 3 atom percent) stabilized the fine, equiaxed, as-extruded grain structure (FIG. 5*a*) for short term exposures at temperatures in excess of 2400° F (1316° C) as illustrated in FIG. 5*b*. (Regular Co base alloys are in fact molten (in part) at 2350° F and higher). Stored energy due to thermo mechanical working (TMT) of the as-extruded rod (cold work plus intermediate anneals) was retained up to 4 hours exposure at 2300° F (1260° C) as indicated by tensile property data in Table 1 below:

TABLE 1

| ALLOY | YS (0.2%) ksi | UTS ksi | ELONG % | R.A. % |
|---|---|---|---|---|
| as HIP & extruded | 132 | 187 | 4 | 4 |
| 30% reduction in area with intermediate anneals | 200 | 250 | 13 | 14 |
| 1 ditto above + 4 hours 2300° F | 174 | 235 | 13 | 14 |

Figure 6:
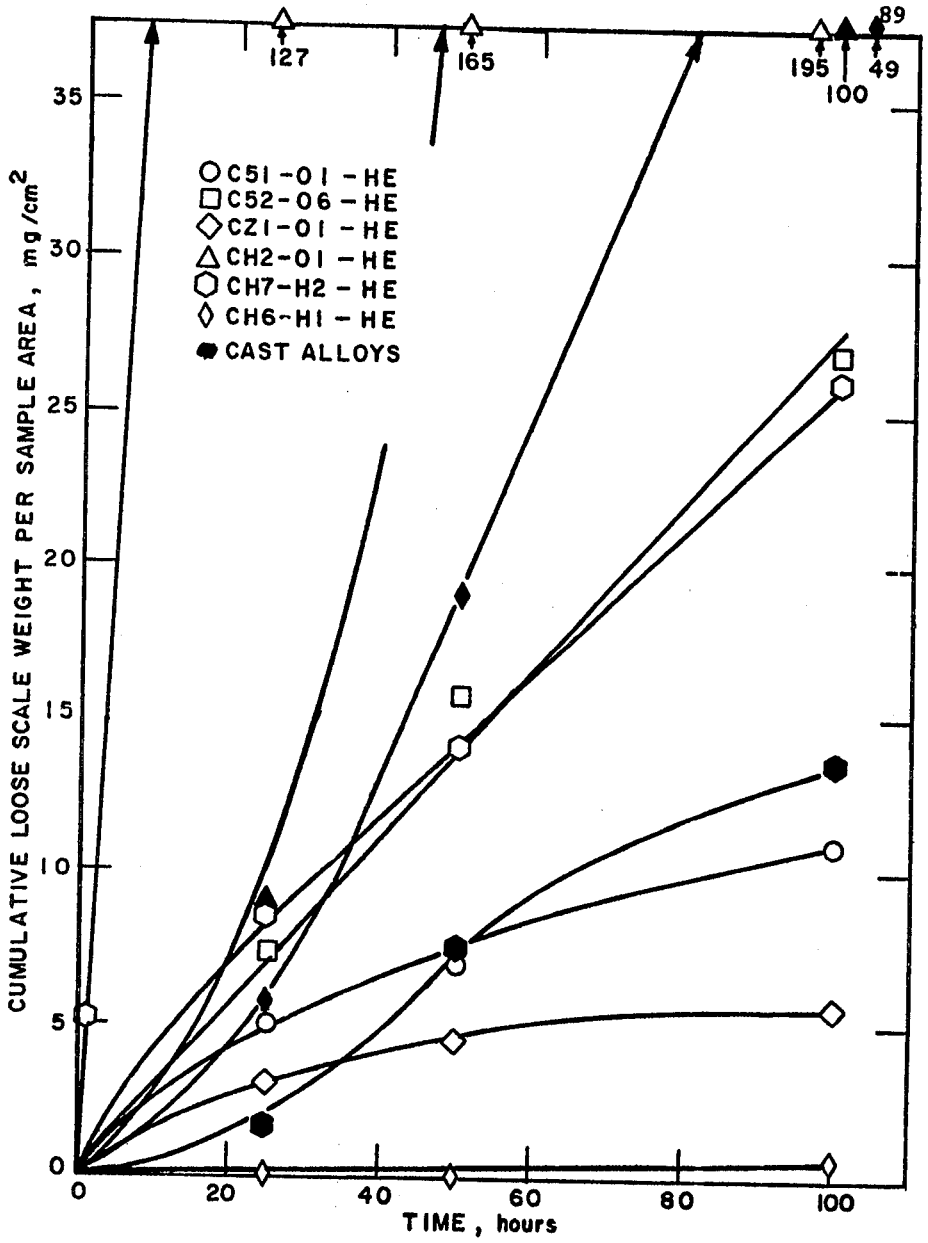
FIG. 6 is a graph of scaling characteristics of most of the alloys represented in FIG. 5, in still air at 2000° F (1093° C)
Figure 7:
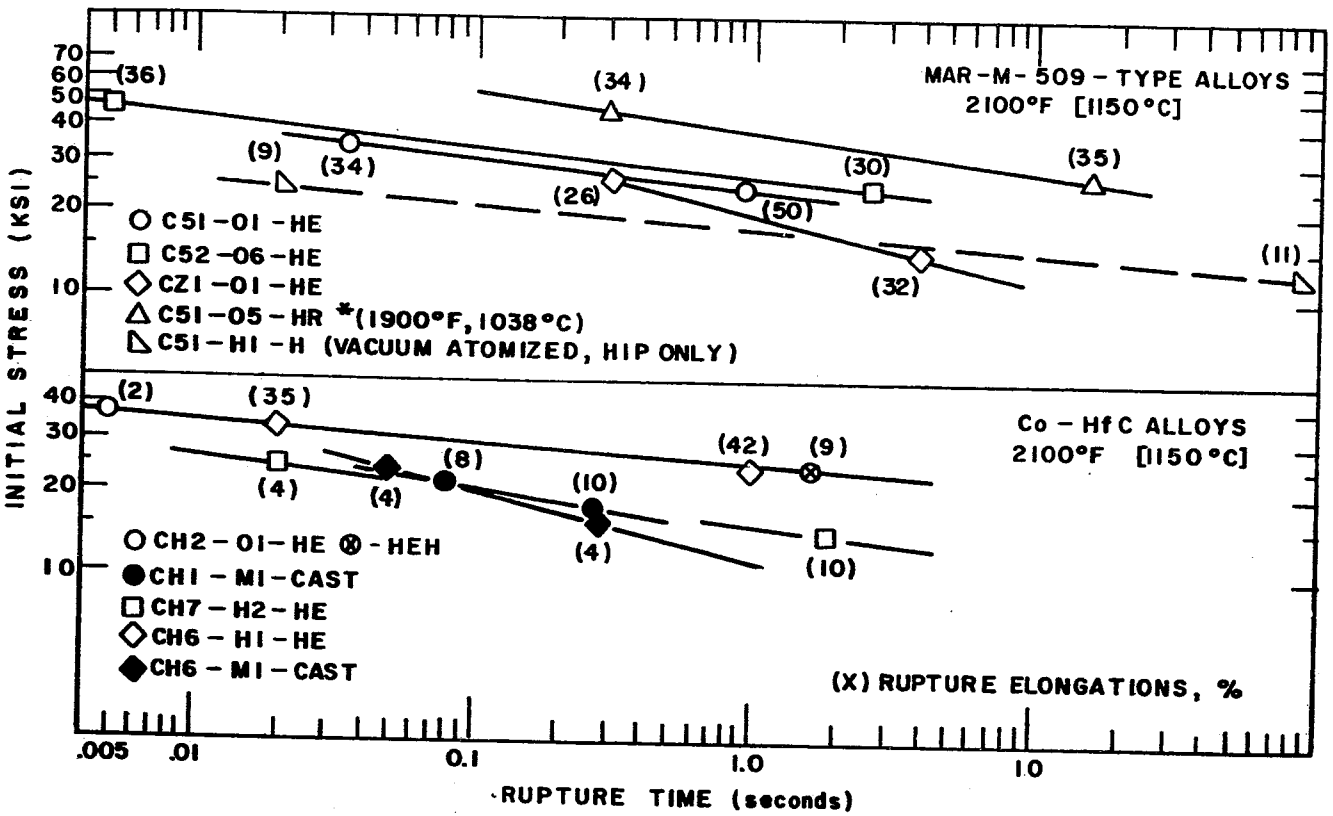
FIG. 7 is a graphic representation of high strain rate, stress-rupture data for most of the alloys represented in FIGS. 5 and 6 plus some others.
Figure 8:
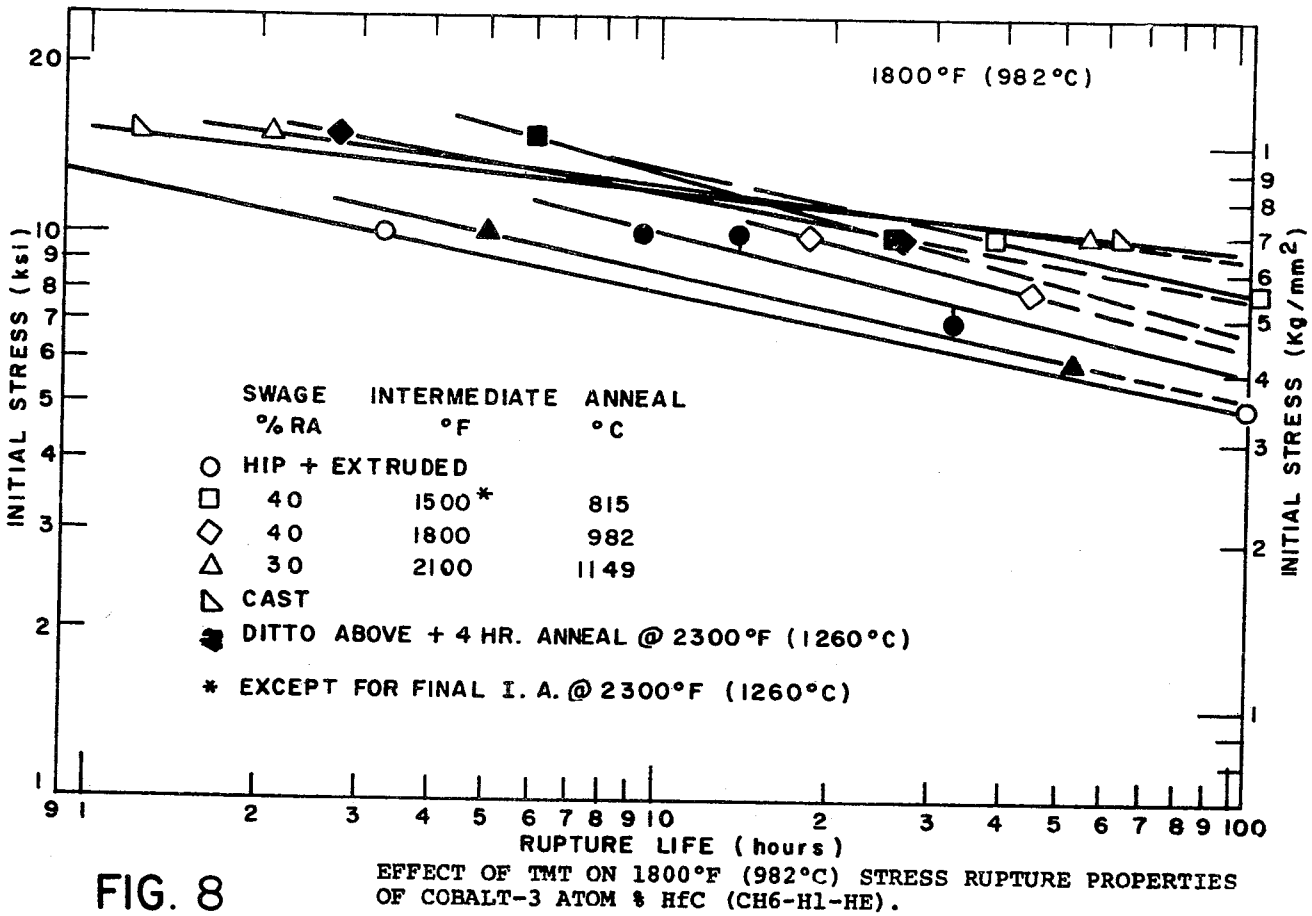
FIG. 8 is a graph of initial stress vs. rupture life for an alloy designated CH6-H1-HE, as hereinafter defined, that was made employing the present concepts and subjected to thermo-mechanical working.

Thermo-mechanical working was found effective to increase room temperature ultimate tensile strength and yield strength from 187 and 132 ksi to 250 and 200 ksi, respectively. Such working increased the stress rupture strength for 100 hour life at 1800° F from 5 to 9.3 ksi; ductilities of this alloy are comparable to typical P/M alloys exceeding the ductilities of precision-cast cobalt alloys by factors of 2–20. Oxidation resistance in static air at 2000° F (1093° C) is comparable to or exceeds that of the best commercially available cobalt-based super alloy (see FIGS. 6 and 7). Grain structure, even after swage-anneal treatments, was found to be very stable to annealing treatment up to 100 hours at 2300° F.

EXAMPLE 2

Cobalt-based hafnium-carbon alloys, with varying amounts of nickel, chromium and molybdenum in solution were dispersion hardened with up to 12 weight % HfC, using the rapid quenching powder metallurgy approach. Alloys containing the desired amount of Hf + C and solid solution additives were obtained initially in vacuum-melted ingot form using conventional ingot technology, or alloying additives were put into the melt prior to atomization, or combinations of each method were employed. Stoichiometric, sub-stoichiometric, and super-stoichiometric additions of carbon were made so as to be able to form exactly the compound HfC, HfC with excess Hf and HfC with excess carbon contents, respectively. When Hf was added to the melt just prior to atomization, it was stirred into the melt after all other alloying additions had been made. After stirring in the Hf addition, the melt was held at about 2800° F (1500° C) for about one-half hour prior to atomizing. Using this method, complete homogenization of the melt was effected without undue oxidation-reaction of the hafnium with its environment, e.g. atmosphere and/or crucible. The molten alloys were atomized using steam, rotating electrode, and hydrogen-vacuum techniques to form rapidly quenched alloy particles having average sizes of 2,000, 350, and 100 microns (micrometers), respectively. The only powder requiring subsequent cleaning was the steam atomized powder which was subjected to repeated cycles of one hour each in hot aqueous, near alkaline potassium permanganate, followed by tumbling in inhibited HCl (hydrochloric acid) repeated up to 4–10 cycles.

After atomization (and cleaning for steam atomized powder), the powders were loaded into mild steel cans which were subsequently sealed except for a vacuum outgas tube through which the loaded can was evacuated while heating to about 700° F (371° C), at which temperature the evacuation tube was crimped and welded shut. The evacuated and sealed cans were then cooled and placed in a hot isostatic pressing (HIP) autoclave which was subsequently pressurized from 15,000 to 30,000 psi for 1–2 hours at temperatures from 2000° F (1093° C) to 2325° F (1274° C) using argon gas as the pressurizing fluid.

After hot isostatic pressing or otherwise consolidating the powders into a fully dense form, the now consolidated powders were either further worked using hot or warm rolling or hot extrusion methods or the consolidated powders were tested and evaluated in the hot isostatically pressed form. The majority of the alloys were both HIP and extruded; therefore, operating parameters for both of these operations were found and are given in the thesis. Standard extrusion methods were employed with extrusion pre-heat temperatures ranging from 2000° F (1093° C) to 2050° F (1121° C) and extrusion ratios varying from 11:1 to 22:1.

Consolidated alloys were examined in detail using various mechanical, chemical, physical and metallographic techniques. The testing procedures employed are known to workers in this art and, further, are discussed in great detail in the Robinson thesis. It should be noted that the discussion is applicable regardless whether the consolidated-powder, metallurgy product was hot isostatically pressed only, or whether it was subsequently hot or warm worked by extrusion and/or rolling methods.

In addition to examining the produced properties of these alloys, additional metallurgical treatments were conducted to enhance the strength, structure, and stability of the alloys. High temperature solutionizing, aging, grain coarsening and oxidation treatments were employed. All treatments at temperatures up to and including 2000° F (1093° C) were conducted in a static furnace-air atmosphere. For temperatures exceeding 2000° F (1093° C), test specimens and samples were either vacuum sealed in Vycor or quartz tubing, or they were packed in alumina boats which were subsequently placed in ceramic tubes continuously purged with flowing argon gas. Specimens used for the oxidation studies were placed in loosely-fitting, high purity alumina tubes to collect any loose scale. In all cases thermocouples were placed in the immediate vicinity of the specimens. All cooling was air cooling unless water quenching is otherwise specified.

Thermomechanical treatments were conducted using the standard swage-anneal techniques. All HIP plus extruded P/M alloys were given swage-anneal treatments consisting of cold swaging up to a total of 40% reduction in area (RA) with intermediate anneals after about 10% RA for 1 hour at 1500° F (816° C), 1800° F (982° C), (1149° C), and 2300° F (1260° C) for selected alloys. The majority of the swaging was done at M.I.T. on a Fen 3F swager. The mild steel cladding was removed from the extruded rods by dissolving in a 1:1 nitric acid solution prior to swaging.

EXAMPLE 3

Example 3 differs from Example 2 in four major respects: (1) a commercially available cobalt-base casting alloy was selected for the starting composition (MAR-M-509); (2) only steam and hydrogen-vacuum atomization techniques were employed, (3) tantalum, zirconium, and chromium carbides were precipitated during atomization and subsequent high temperature treatments in contrast to the predominantly single precipitate, HfC, in Example 2; and (4) Example 3 alloys responded to high temperature grain coarsening and solutionizing/aging treatments whereas the stability of the Example 2 alloys was such that little or no high temperature structure instabilities were noted right up to the incipient melting points of the alloys.

The results of room temperature tensile tests for alloys of Example 2 and Example 3 are shown in tables 2 and 3, respectively, some further strength characteristics are shown in FIGS. 8–10 and FIGS. 11–12, respectively, and further test results are given in the thesis.

TABLE 2

ROOM TEMPERATURE TENSILE PROPERTIES OF Co-HfC P/M AND CAST ALLOYS

| ALLOY | YS (0.2%) ksi | UTS ksi | Elong. % | R.A. % |
|---|---|---|---|---|
| Co-1 atom % HfC | | | | |
| CH1-M1-cast | 60 | 82 | 12 | — |
| CH2-O1-He-(HIP + Extr) | 98 | 142 | 4 | 6 |
| HEHS30N18A6 | 132 | 160 | 5.2 | 7.8 |
| HEHS40N21A6 | 168 | 186 | 11 | 12 |
| Co-2 atom % HfC | | | | |
| CH7-M1-cast | 80 | 101 | 1.2 | 1 |
| CH8-C1-HIP only | 117 | 117 | <1 | <1 |
| CH7-H2-HE(HIP + Extr) | 105 | 154 | 7 | 5 |
| CH7-H2-HE S30N15*A6 | 139 | 183 | 22 | 19 |
| CH7-H2-HE S30N18A6 | 169 | 204 | 5 | 6 |
| Co-3 atom % HfC | | | | |
| CH6-M1-cast | ~60 | 77 | 1.5 | 1 |
| CH4-M1-CR(5:1RA at 2100)A6 | 148 | 170 | 12 | 8 |
| CH6-H1-HE(HIP + Extr) | 132 | 187 | 4 | 4 |
| T23(4)A6 | 136 | 188 | 26 | 23 |
| S20N15A6 | 203 | 250 | 9 | 10 |
| S30N15A10 | 255 | 255 | <1 | <1 |
| S30N15A6 | 200 | 250 | 13 | 14 |
| S30N15T23(4)A6 | 174 | 235 | 13 | 14 |
| S20N18A6 | 151 | 201 | 26 | 24 |
| CH6-H1-HES30N18A10 | 279 | 299 | 1 | 1 |
| S40N18A6 | 134 | 190 | 25 | 16 |
| S20N21 | 210 | 222 | 7.2 | 12 |
| S30N21T23(4)A6 | 126 | 181 | 26 | 19 |

*Except for final I.A. at 2100° F.

TABLE 3

ROOM TEMPERATURE TENSILE PROPERTIES OF MAR-M-509-TYPE P/M ALLOYS

| ALLOY HIP + EXTRUDED ALLOYS | YS (0.2%) ksi | UTS ksi | Elong % | R.A. % |
|---|---|---|---|---|
| MAR-M-509 P/M Alloy | | | | |
| C51-01-HE | 135 | 190 | 11 | 8 |
| C51-01-HE | 123 | 195 | 17 | 14 |
| T23(4) no age | 96 | 166 | 24 | 21 |
| S20N15A6 | 169 | 202 | 13 | 18 |
| S40N15*A6 | 166 | 198 | 13 | 15 |
| S30N18A6 | 164 | 200 | 14 | 12 |
| H1 W, Cr, and C Modification | | | | |
| C52-06-HE | 138 | 182 | 3 | 2 |
| T23(4)A6 | 130 | 174 | 15 | 12 |
| S30N21A6 | 166 | 198 | 12 | 14 |
| Hi Zr Modification | | | | |
| CZ1-01-HE | 129 | 188 | 6 | 7 |
| S22N15*A6 | 158 | 190 | 7.4 | 2 |
| S22N15*T23(4)A6 | 117 | 161 | 11 | 10 |
| HIP'ed MAR-M-509 P/M Alloys | | | | |
| C51-034-H2000(2) | 98 | 119 | 0.7 | <1 |

TABLE 3-continued

ROOM TEMPERATURE TENSILE PROPERTIES OF MAR-M-509-TYPE P/M ALLOYS

| ALLOY HIP + EXTRUDED ALLOYS | YS (0.2%) ksi | UTS ksi | Elong % | R.A. % |
|---|---|---|---|---|
| C51-H1-H2235(2) | 122 | 161 | 6 | 6 |
| HIP'ed + Hot Rolled MAR-M-509 P/M Alloys | | | | |
| Longitudinal direction | 150 | 188 | 2 | 2 |
| C51-05-HR'(2:1RA at 1800) | 239 | 251 | <2 | <1 |
| HR'R(2:1 RA at 1400) | 305 | 307 | <1 | <1 |

*except for final I.A. at 2100° F (1149° C).

In the tables and in some of the figures certain shorthand terms are used to designate alloys made and tested. A listing of the characteristics of the terms used in the present specification follows. The terms employed have three groupings. Thus, for example, in the designation CH1-M1-cast, the first group, CH1, relates to: a standard master alloy, 1 atom % HfC; the second group, M1, relates to: M.I.T., heat #1; and the third group, cast or $C_1$, relates to a cast product. The further designations for the first group are now given: C5X = MAR-M-509-type alloy; C51 = standard casting alloy chemistry; C52 = Hi W, Cr, and C modified chemistry; CZ1 = Hi Zr modification, otherwise standard chemistry; CZX = M.I.T.'s cobalt-HfC alloy, in each case starting with the master alloy; CH1 = standard master alloy chemistry, 1 atom % HfC; CH2 = 0.84% silicon and 0.04% boron added; CH3 = 0.05% boron plus Hf and C added to yield 3 atom % HfC; CH4 = Hf and C added to yield 3 atom % HfC, CH5 = 1% silicon, 0.05% boron, Hf and C added to yield 3 atom % HfC; CH6 = Cr, Ni, C and Hf added to yield master alloy nominals except with 3 atom % HfC; CH7 = Cr, Ni, C and Hf added to yield nominals except 3 atom % C and 2 atom % Hf. The second group specifies the sources of the alloy which were Alleghany Ludlum, Chemstrad Homogeneous Metals, M.I.T. and I.M.T. The third group specifies processing: A = age; A6 = age 1600°-1650° F for 20 hours; A21(4) = age 2100° F for 4 hours; (Ageing times are always 20 hours unless specified otherwise in brackets.); C = cast; E = extrude; H = HIP; M - "melt dip" sample casting taken just prior to atomization; N = intermediate anneals after approximately each 10% RA; N18 = intermediate anneal at 1800° F (982° C) for 1 hour; R = rolled (hot generally); R17 = rolled at 1800° F (982° C); S40 = swaged to a total 40% reduction in area; T = heat treatment, e.g., solutionizing, grain coarsening, etc., for 1 hour unless otherwise specified; T20(4) = heat at 2000° F (1093° C) for 4 hours. Fractional 100° F (56° C) increments are written out in full.

Figure 9:
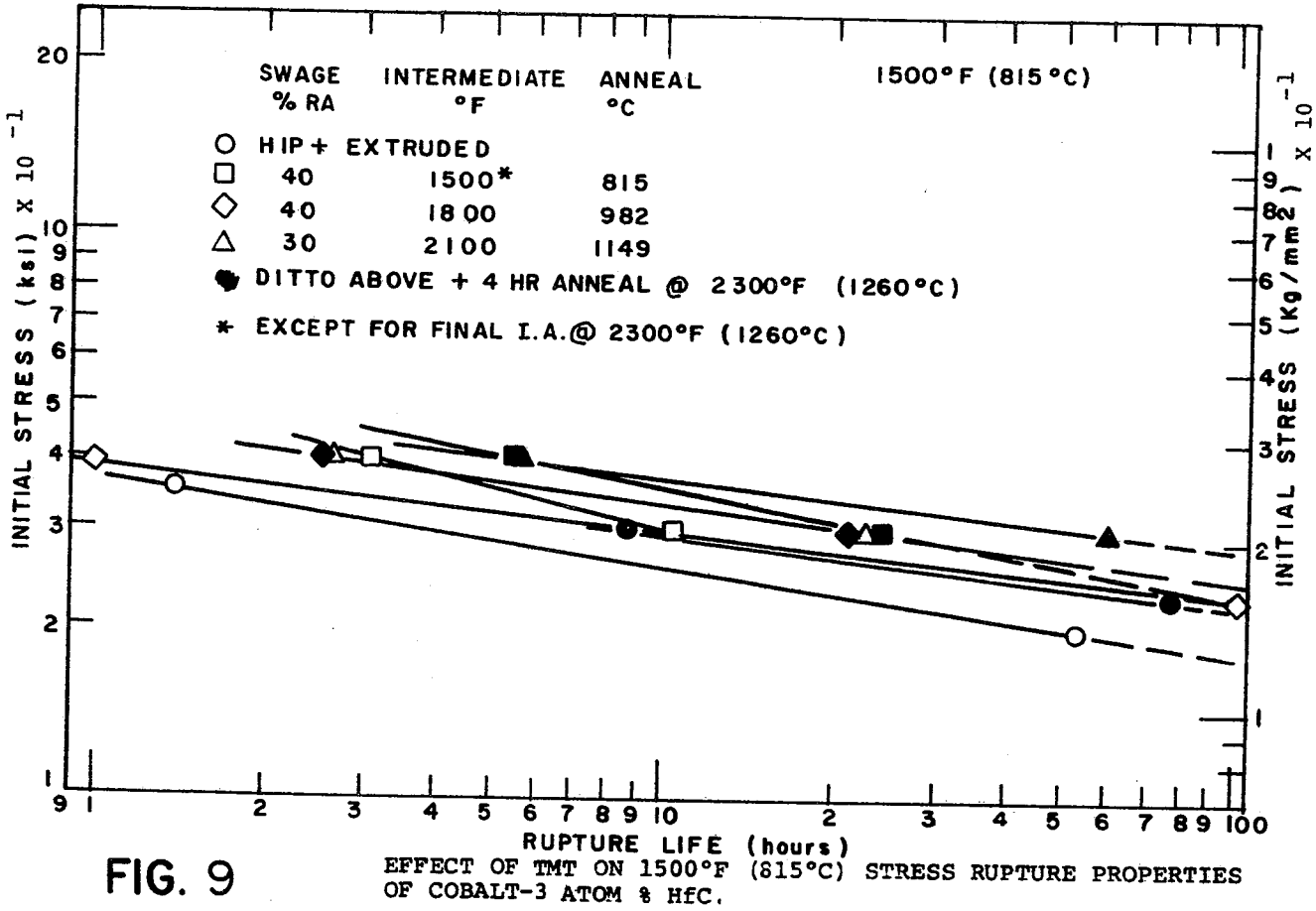
FIG. 9 is a graph like that of FIG. 8 except for a cobalt-3 atom % HfC alloy.
Figure 10:
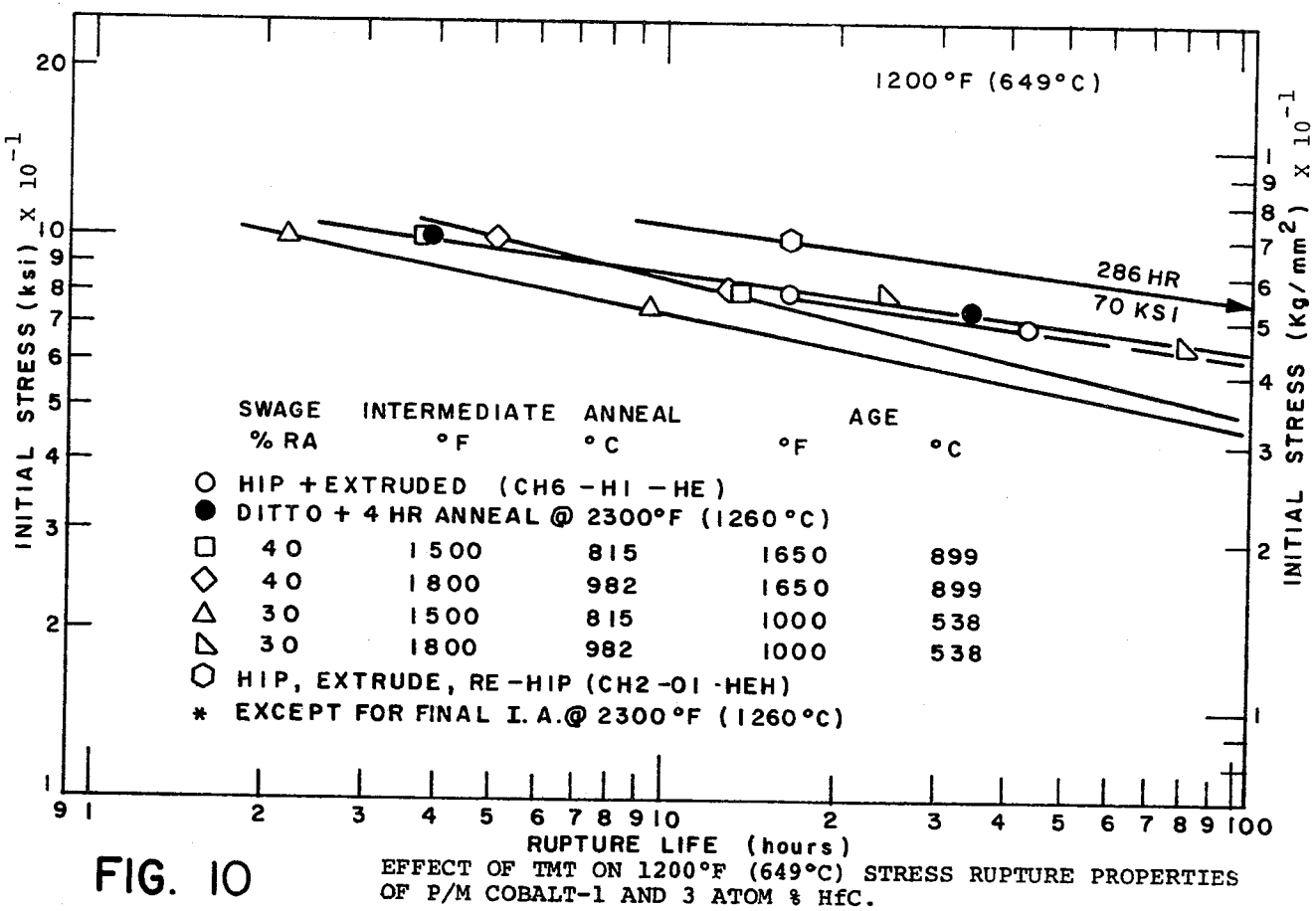
FIG. 10 is a graph like that of FIG. 8 except for P/M cobalt-1 and 3 atom % HfC alloys.
Figure 11:
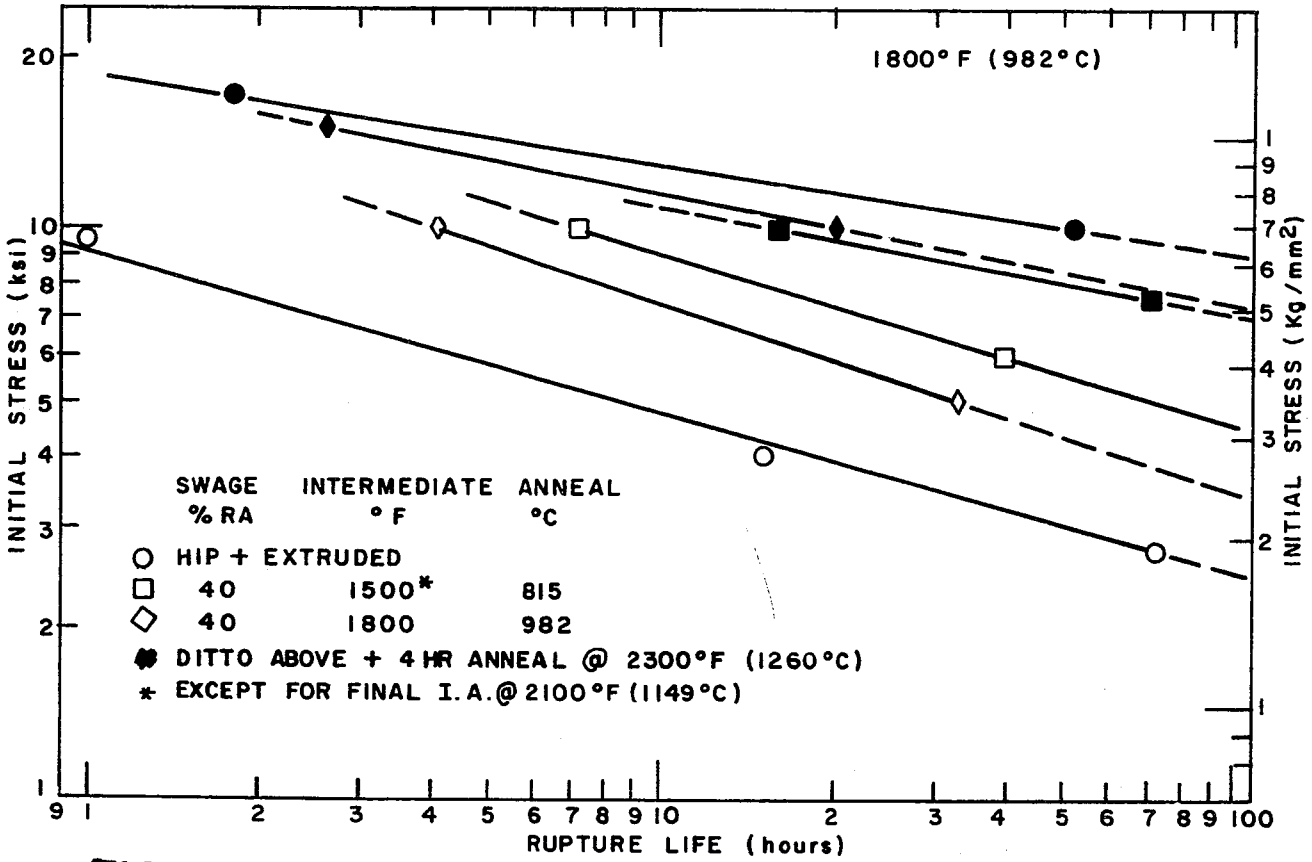
FIGS. 11 and 12 each are graphs like that of FIG. 8 except for a P/M alloy designated MAR-M-509 which is a commercially available alloy modified in accordance with the present teachings.
Figure 12:
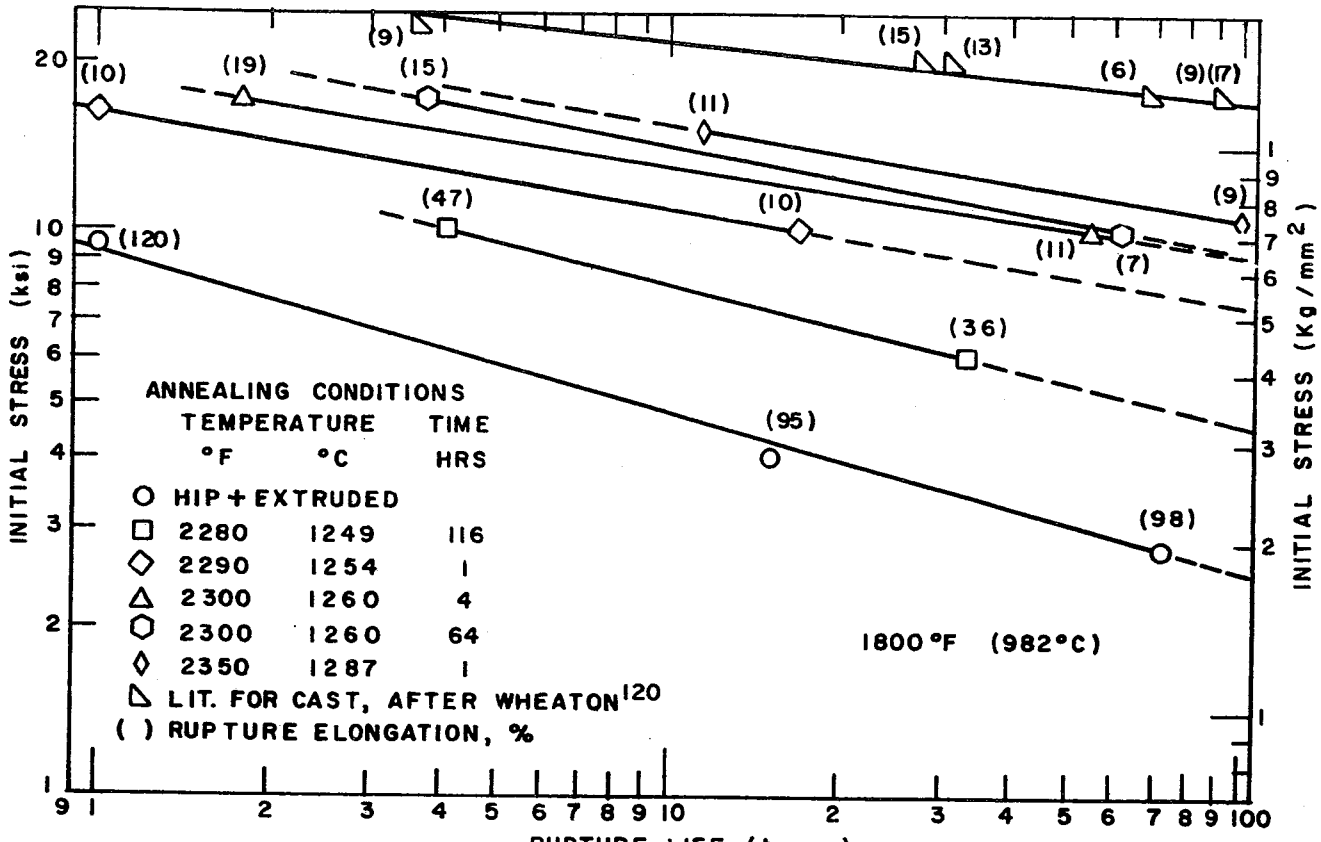

The foregoing teaching demonstrates that the rapid-quenching approach can be employed to modify and improve the structure and properties of contemporary cobalt-based casting alloys and to develop a new class of cobalt-based alloys which have a unique combination of strength, structure, stability, and oxidative resistance. There is produced a Co-HfC alloy which is sufficiently malleable to allow its use in wrought processes (FIG. 9). The powders can be consolidated directly by hot extrusion rolling, forging, etc. or by hot isostatic pressing into a dense billet for hot working by extrusion, rolling, forging, etc. The alloy has extemely fine grain and carbide precipitate sizes and exhibits excellent low temperature toughness at (−100° F), room temperature and high temperature (2000° F and up to 2300° F) yield strength and ultimate strength values which far exceed both cast or hot worked (wrought) contemporary cobalt base superalloys. The following table shows the extremely high toughness or resistance to impact of the present class of alloys down to the liquid nitrogen temperature.

TABLE 4

| Alloy | ft.-lbs 21° C | ft.-lbs −196° C |
|---|---|---|
| C51-01-HE (MAR-M-509 alloy) | 7 | — |
| C52-06-HE (MAR-M-509 alloy) | 5 | 5 |
| CZ1-01-HE (Modified MAR-M-509 alloy) | 12 | — |
| CH2-01-HEH2 (Co-HfC-1 at %) | 82 | — |
| CH7-H2-HE (Co-HfC-3 at %) | 20 | 22 |
| CH6-H1-HE (Co-HfC-6 at %) | 21 | 16 |

The rapid cooling to provide the desired results can be effected by splat cooling in combination with the powder forming techniques herein described or as an alternate approach, or the liquid melt can be forced through one or more orifices to permit surface tension to provide spheres.

The foregoing discussion of the invention is directed to the preferred embodiment thereof, namely, that of providing cobalt-based alloys with an unusually large amount of hafnium (i.e., 3–15% weight hafnium) in the form HfC (2–15% by volume). The process described teaches a way of forming, preferentially, HfC in such alloys. But the invention is not restricted to cobalt-based alloys alone. As is previously noted, up to 30% of the cobalt can be substituted with nickel or iron plus nickel and, in general, the process described is useful to provide substantial amounts of hafnium in an alloy containing 10–30 weight % chromium, 4–12 weight % tungsten and/or molybdenum, 3–15 weight % hafnium, sufficient carbon to produce hafnium carbide in an alloy wherein the balance is a ductile, tough, oxidation-resistant matrix such as, for example, nickel and/or nickel plus iron. The very essence of the invention is the discovery of a method whereby hafnium carbide is formed preferentially or optimally, in an alloy which contains other constituents which would, in the absence of the present teaching, tend to preclude such hafnium carbide formation; and the hafnium carbide thus formed is in a particle size finer than about 3 microns.

Further modifications of the invention herein described will occur to persons skilled in the art, and all such modifications are deemed to be within the spirit and scope of the invention as defined by the claims.

What is claimed is:

1. A cobalt-based alloy having a uniform dispersion of extremely fine and stable microconstituent phases, that consists essentially of 10–30 weight % chromium, 4–12 weight % tungsten and/or molybdenum, hafnium carbide of particle size less than 3 microns and in the range 2 to 15% by volume, and the rest a ductile, tough, oxidation-resistant cobalt matrix and incidental impurities, all the Hf and the C in the alloy being in the form of HfC.

2. A powder as claimed in claim 1 in which up to 30% of the cobalt is substituted by nickel or nickel plus iron.

3. A powder as claimed in claim 1 in which some of the cobalt is substituted by nickel or nickel plus iron.

4. A powder as claimed in claim 1 in which all the cobalt is substituted by nickel or nickel plus iron.

* * * * *